US009885522B2

(12) United States Patent
Shin et al.

(10) Patent No.: US 9,885,522 B2
(45) Date of Patent: Feb. 6, 2018

(54) HEAT EXCHANGER AND CASE FOR THE SAME

(71) Applicant: HANWHA TECHWIN CO.,LTD., Changwon-si (KR)

(72) Inventors: Dong-Hu Shin, Changwon (KR); Ho-youl Park, Changwon (KR); Hong-gi Park, Changwon (KR)

(73) Assignee: Hanwha Techwin Co., Ltd., Changwon-si (KR)

( * ) Notice: Subject to any disclaimer, the term of this patent is extended or adjusted under 35 U.S.C. 154(b) by 1072 days.

(21) Appl. No.: 14/076,690

(22) Filed: Nov. 11, 2013

(65) Prior Publication Data

US 2015/0007968 A1 Jan. 8, 2015

(30) Foreign Application Priority Data

Jul. 8, 2013 (KR) ..... 10-2013-0079910

(51) Int. Cl.

| | |
|---|---|
| ***F28D 7/06*** | (2006.01) |
| ***F28D 7/16*** | (2006.01) |
| ***F28F 9/00*** | (2006.01) |
| ***F28F 9/26*** | (2006.01) |
| ***F28D 7/00*** | (2006.01) |
| *F28D 21/00* | (2006.01) |

(52) U.S. Cl.

CPC ..... *F28D 7/1661* (2013.01); *F28D 7/0066* (2013.01); *F28F 9/00* (2013.01); *F28F 9/26* (2013.01); *F28D 2021/0049* (2013.01)

(58) Field of Classification Search

CPC ..... F28D 7/06; F28D 7/006; F28D 7/0075; F28D 7/0083

USPC ..... 165/140, 145, 157, 158, 163

See application file for complete search history.

(56) References Cited

U.S. PATENT DOCUMENTS 1,139,081 A * 5/1915 Stone ..... F28D 1/0435 123/555
1,918,608 A * 7/1933 Mahoney ..... C10G 7/00 165/114
2,360,408 A * 10/1944 Dunn et al. ..... F23K 5/20 165/104.19
2,397,069 A * 3/1946 Young et al. ..... F01P 3/18 165/110

(Continued)

FOREIGN PATENT DOCUMENTS

KR 10-2007-0095171 A 9/2007
KR 10-2011-0124025 A 11/2011

(Continued)

*Primary Examiner* — Allen Flanigan
(74) *Attorney, Agent, or Firm* — Sughrue Mion, PLLC

(57) ABSTRACT

Provided is a heat exchanger. The heat exchanger includes a case including a plurality of chambers, each of the plurality of chambers having a chamber entry opening to the outside; and a plurality of heat exchange tubes accommodated in the each of the plurality of chambers, where each heat exchange tube includes an inlet portion; an outlet portion; and an intermediate portion connected between the inlet portion and the outlet portion, wherein each heat exchange tube of one of the plurality of chambers is arranged as a mirror image from corresponding heat exchange tube of an adjacent chamber of the one of the plurality of chambers with respect to a wall disposed between the one and the adjacent chambers.

13 Claims, 8 Drawing Sheets

(56) References Cited

U.S. PATENT DOCUMENTS

| | | | | |
|---|---|---|---|---|
| 4,450,904 | A * | 5/1984 | Volz | B23P 15/26 122/510 |
| 4,641,607 | A * | 2/1987 | Balazs et al. | B01D 3/065 122/209.1 |
| 4,653,578 | A * | 3/1987 | Horning | F28D 7/06 122/379 |
| 5,390,730 | A * | 2/1995 | Goelzer | F28D 7/0083 165/108 |
| 8,495,890 | B2 | 7/2013 | Jadric et al. | |
| 8,794,299 | B2 * | 8/2014 | Barfknecht et al. | F28D 7/1692 123/568.12 |
| 2007/0215330 | A1 | 9/2007 | Umetsu et al. | |
| 2012/0279252 | A1 | 11/2012 | Carlin et al. | |

FOREIGN PATENT DOCUMENTS

| | | | |
|---|---|---|---|
| KR | 10-2012-0033964 | A | 4/2012 |
| KR | 10-2012-098860 | A | 9/2012 |

* cited by examiner

HEAT EXCHANGER AND CASE FOR THE SAME

CROSS-REFERENCE TO RELATED APPLICATION

This application claims priority from Korean Patent Application No. 10-2013-0079910, filed on Jul. 8, 2013, in the Korean Intellectual Property Office, the disclosure of which is incorporated herein by reference in its entirety.

BACKGROUND

1. Field

Apparatuses consistent with exemplary embodiments relate to a heat exchanger and a case for the heat exchanger, and more particularly, to a heat exchanger and a case for the heat exchanger with improved heat exchange performance and compact structure.

2. Description of the Related Art

Heat exchangers are used to exchange heat between heat transfer media having different temperatures by directly or indirectly contacting each other, and such heat exchangers are applied to various fluid mechanical systems such as heat engines or cooling systems.

To cool fluids that are used in a fluid mechanical system such as a multi-stage compressor having a plurality of compression stages, a heat exchanger is also designed to have a plurality of heat exchange chambers corresponding to the number of the respective compression stages. However, in a heat exchanger of the related art including a plurality of heat exchange chambers, each chamber having a chamber wall, a distance between adjacent heat exchange chambers is quite long, so the overall size of the heat exchanger is increased.

Furthermore, although each heat exchange chamber has a higher temperature region and a lower temperature region, the heat exchanger of the related art is designed without considering the thermal characteristics of the different regions of the heat exchange chambers, so the heat exchanger of the related art has a limitation on improving heat exchange performance.

The heat exchanger of the related art is also configured such that a passage through which a heat exchange fluid exchanging heat is circulated into a heat exchange chamber projects out from the heat exchange chamber, thereby increasing the overall size of the heat exchanger. Furthermore, since an oil passageway through which oil used for lubrication or other purposes passes is disposed in the heat exchanger without considering thermal characteristics of the heat exchanger, the heat exchanger of the related art has a limitation with respect to the heat exchange performance.

SUMMARY

One or more exemplary embodiments provide a heat exchanger and a case for the heat exchanger adapted to provide improved heat exchange performance and the heat exchanger having a compact structure and a reduced overall size.

One or more exemplary embodiments provide a heat exchanger and a case for the heat exchanger designed in consideration of thermal characteristics of a plurality of chambers where heat exchange occurs.

Additional aspects will be set forth in part in the description which follows and, in part, will be apparent from the description, or may be learned by practice of the exemplary embodiments.

According an aspect of an exemplary embodiment, there is provided heat exchanger including: a case comprising a plurality of chambers, each of the plurality of chambers having a chamber entry opening to the outside; and a plurality of heat exchange tubes accommodated in the each of the plurality of chambers, where each heat exchange tube includes: an inlet portion; an outlet portion; and an intermediate portion connected between the inlet portion and the outlet portion, wherein each heat exchange tube of one of the plurality of chambers is arranged as a mirror image from corresponding heat exchange tube of an adjacent chamber of the one of the plurality of chambers with respect to a wall disposed between the one and the adjacent chambers.

The plurality of chambers may extend in a parallel direction from one another.

The inlet and outlet portions may extend in an extending direction of the plurality of chambers, wherein the inlet portion may be configured to take in an externally introduced heat transfer fluid and the outlet portion may be configured to discharge the heat transfer fluid, and wherein the intermediate portion comprises a bent portion.

The inlet portion of the each heat exchange tube of the one of the plurality of chambers may be arranged as a mirror image from the inlet portion of the each heat exchange tube of the adjacent chamber of the one of the plurality of chambers with respect to the wall disposed between the one and the adjacent chambers, and wherein the outlet portion of the each heat exchange tube of the one of the plurality of chambers may be arranged as a mirror image from the outlet portion of the each heat exchange tube of the adjacent chamber of the one of the plurality of chambers with respect to the wall disposed between the one and the adjacent chambers.

The each of the plurality of chambers may share a single wall with an adjacent chamber of the each of the plurality of chambers.

The case may further include fluid entrances, each of the fluid entrances configured to supply a heat exchange fluid to respective one of the plurality of chambers; and fluid exits, each of the fluid exits configured to discharge the heat exchange fluid to the outside from the respective one of the plurality of chambers, wherein the fluid entrance and the fluid exit of the respective one of the plurality of chambers are disposed within outer-most walls of the respective one of the plurality of chambers.

At least one of the fluid entrance and the fluid exit of the respective one of the plurality of chambers may include a quadrangular cross-section.

At least one of the fluid entrance and the fluid exit of the respective one of the plurality of chambers may include an extended portion extending to the adjacent chamber of one of the plurality of chambers.

The case may further include an oil passageway that is disposed between adjacent ones of the chambers.

The oil passageway may be disposed at a lower temperature region, and the lower temperature region may be a region having only an inlet portion of the each of the heat exchange tubes of one of the plurality of chambers and only an inlet portion of the each of the heat exchange tubes of the adjacent chamber of the plurality of chambers.

The oil passageway may extend in an extending direction of the each of the plurality of chambers, and may include an oil entrance for introducing oil; and an oil exit for discharging oil.

The inlet portion and the outlet portion of the each of the heat exchange tubes may be disposed from each other in a direction corresponding to an arranging direction of the plurality of chambers, and a direction in which the inlet and outlet portions of the each of the heat exchange tubes may be arranged in adjacent ones of the chambers is changed alternately.

The inlet portion and the outlet portion of the each of the heat exchange tubes may be disposed from each other corresponding to a direction perpendicular to an arranging direction of the plurality of chambers.

According to an aspect to another exemplary embodiment, there is provided a case for a heat exchanger including a plurality of chambers, each of the plurality of chambers having a chamber entry opening to the outside, wherein each chamber of the plurality of chambers shares a single wall with an adjacent chamber of the each chamber, and wherein the plurality of chambers extend in a parallel direction from one another.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
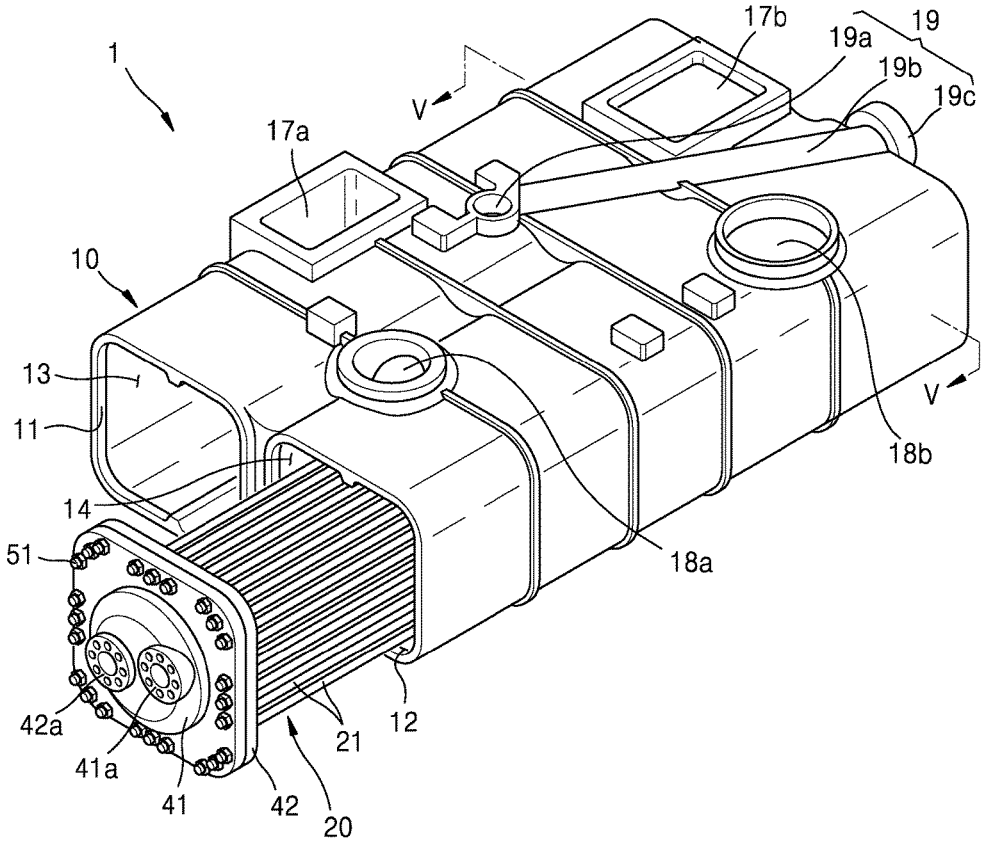
FIG. 1 is a schematic perspective view illustrating coupling relationship between components of a heat exchanger according to an exemplary embodiment.

A heat exchanger and a case for the heat exchanger according to exemplary embodiments\will now be described in detail with reference to the accompanying drawings, wherein like reference numerals refer to the like elements throughout. In this regard, the exemplary embodiments may have different forms and should not be construed as being limited to the descriptions set forth herein. Accordingly, the exemplary embodiments are merely described below, by referring to the figures, to explain aspects of the present description. Expressions such as "at least one of," when preceding a list of elements, modify the entire list of elements and do not modify the individual elements of the list.

FIG. 1 is a schematic perspective view illustrating a coupling relationship between components of a heat exchanger 1 according to an exemplary embodiment.

Referring to FIG. 1, the heat exchanger 1 according to the exemplary embodiment includes a case 10 having a plurality of chambers 13 and 14, and heat exchange tubes 21 housed in the respective chambers 13 and 14. The case 10 accommodates a heat exchange tube assembly 20 through which a heat transfer fluid transferring heat flows in and discharges out, and includes a plurality of chamber entries 11 and 12 opening to the outside from the plurality of chambers 13 and 14, respectively. The case 10 may be made of a metal having heat transfer characteristics.

The chamber entries 11 and 12 not only serve as a passage through the heat exchange tubes 21 of the heat exchange tube assembly 20 are inserted when the heat exchange tube assembly 20 is assembled into the case 10 but also support a cover 41 of the heat exchange tube assembly 20.

The chambers 13 and 14 accommodate the heat exchange tubes 21 of the heat exchange tube assembly 20 and define a space in which heat exchange occurs. The chambers 13 and 14 include the chamber entries 11 and 12, respectively, and are disposed parallel to each other so as to extend inwardly into the case 10.

While the heat exchanger 1 according to the present exemplary embodiment includes the two chambers 13 and 14, the number of chambers is not limited thereto, and may vary depending on the application of the heat exchanger 1.

The case 10 also includes fluid entrances 17*a* and 18*a*, which are disposed and penetrate portions of the chambers 13 and 14 to supply a heat exchange fluid to the chambers 13 and 14, and fluid exits 17*b* and 18*b* that are disposed and penetrate other portions of the chambers 13 and 14 to discharge the heat exchange fluid to the outside. The heat exchange fluid supplied to the chambers 13 and 14 through the fluid entrances 17*a* and 18*a* makes contact with the heat exchange tubes 21 within the chambers 13 and 14 to exchange heat.

When the heat exchanger 1 supplies a heat exchange fluid cooled by heat exchange to each compression stage in a multi-stage compressor, each of the chambers 13 and 14 may serve to cool the heat exchange fluid that is supplied to one of the multiple compression stages. For example, if gas is supplied to one chamber 13 as a heat exchange fluid through the fluid entrance 17*a* having a quadrangular cross-section, the gas cooled by heat exchange within the chamber 13 may then be fed into one compression stage in the multi-stage compressor through the fluid exit 17*b* having a quadrangular cross-section. If gas as a heat exchange fluid is also supplied to another chamber 14 via the fluid entrance 18*a*, the gas cooled by heat exchange within the chamber 14 may then be fed into another compression stage through the fluid exit 18*b*.

The fluid entrance 17*a* and the fluid exit 17*b* having the quadrangular cross-sections may be designed to have areas equal to the fluid entrance 18*a* and the fluid exit 18*b* having circular cross-sections, respectively.

Since the fluid entrance 17*a* of the one chamber 13 and the fluid exit 18*b* of the other chamber 14 are disposed and penetrate within the chambers 13 and 14, respectively, the fluid entrance 17*a* and the fluid exit 18*b* does not project out from the case 10. Thus, this arrangement of the fluid entrance 17*a* and the fluid exit 18*b* does not increase the overall size of the case 10, thereby achieving a compact design.

Figure 2:
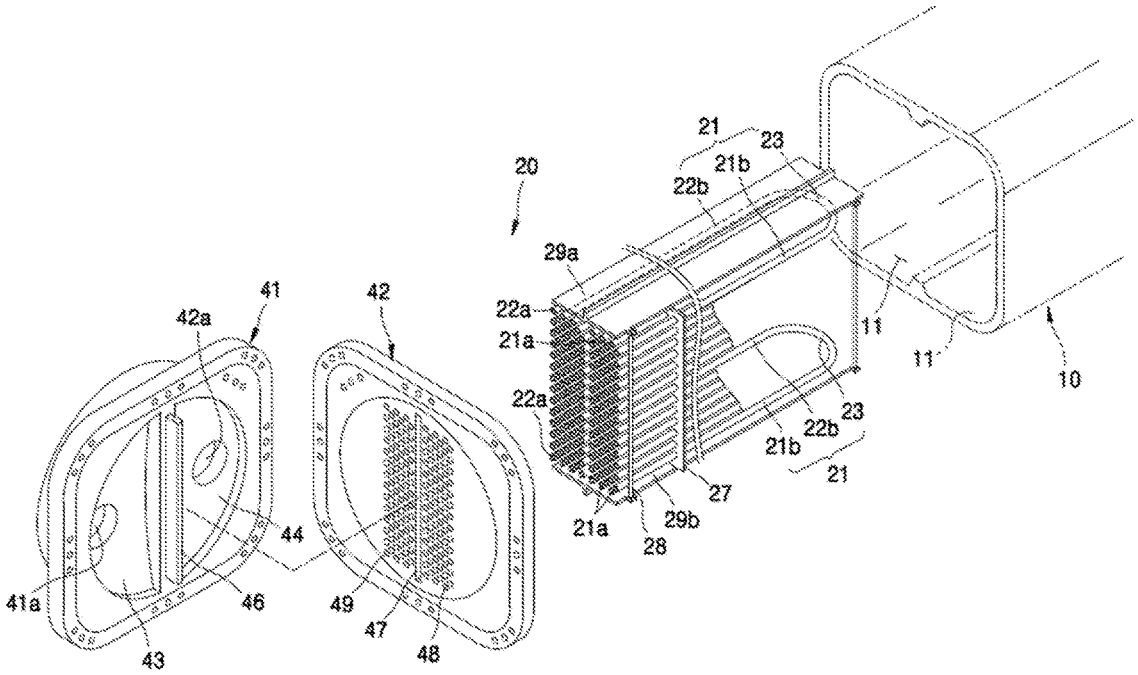
FIG. 2 is a schematic perspective view illustrating a coupling relationship between components of a heat exchange tube assembly in the heat exchanger of FIG. 1 according to an exemplary embodiment.
Figure 3:
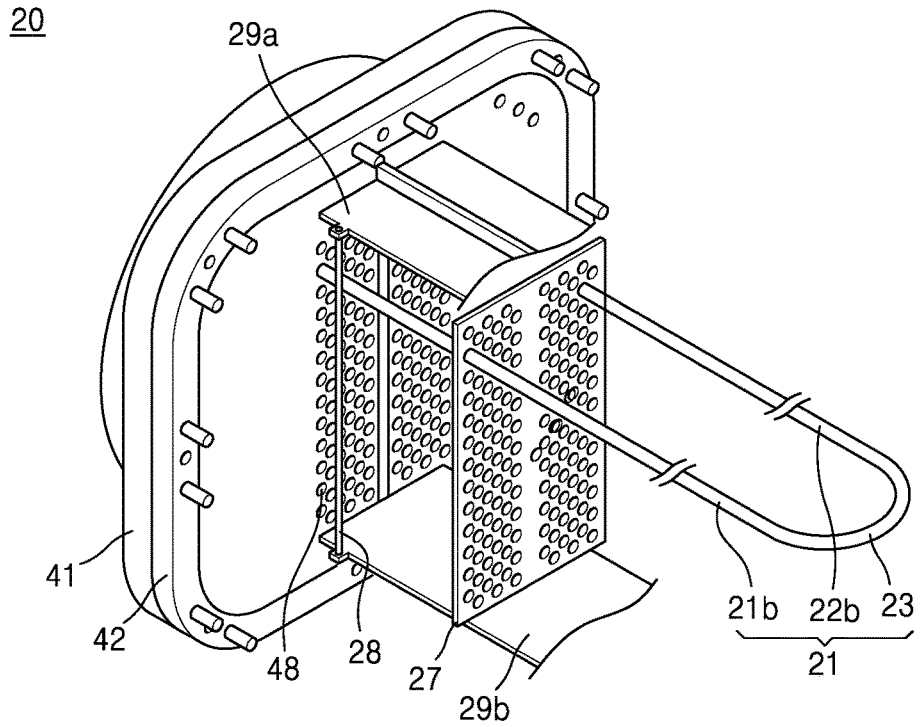
FIG. 3 is a rear perspective view illustrating a state in which the components of the heat exchange tube assembly of FIG. 2 have been assembled together according to an exemplary embodiment.
Figure 4:
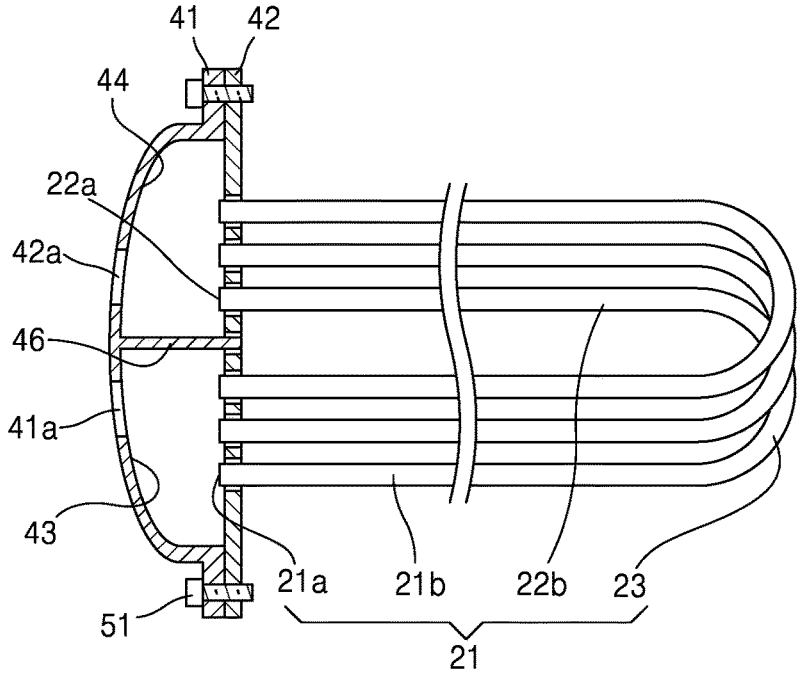
FIG. 4 is a cross-sectional view of the heat exchange tube assembly of FIG. 3 according to an exemplary embodiment.

FIG. 2 is a schematic perspective view illustrating a coupling relationship between components of the heat exchange tube assembly 20 in the heat exchanger 1 of FIG. 1. FIG. 3 is a rear perspective view illustrating a state in which the components of the heat exchange tube assembly 20 of FIG. 2 have been assembled together according to an exemplary embodiment. FIG. 4 is a cross-sectional view of the heat exchange tube assembly 20 of FIG. 3 according to an exemplary embodiment.

Referring to FIG. 2, the heat exchange tube assembly 20 includes the heat exchange tubes 21 inserted into the chamber 13 of the case 10, a support plate 42 disposed at the outside of the case 10 so as to support the heat exchange tubes 21, and a cover 41 provided on an outer surface of the support plate 42 to define a space that allows a heat transfer fluid to flow into or out of the heat exchange tubes 21.

Each of the heat exchange tubes 21 has a hollow cylindrical shape so that a heat transfer fluid can flow therein and is connected to the support plate 42. Each of the heat exchange tubes 21 is bent into an approximate U-shape, and may be formed of a metal having heat transfer characteristics.

Referring to FIGS. 2 and 4, the cover 41 includes an entrance 41*a* into which a heat transfer fluid is introduced and an exit 42*a* from which the heat transfer fluid is discharged. The cover 41 includes a barrier rib 46 that protrude toward the support plate 42. The support plate 42 includes a groove portion 47 for accommodating an end of the barrier rib 46. When the cover 41 and the support plate 42 are joined by a bolt 51, an inlet space 43 and an outlet space 44 are defined by areas between the cover 41 and the support plate 42.

The heat exchange tube 21 includes an inlet portion 21*b* that extends along a direction that the chambers 13 and 14 of the case 10 extend and allows an externally introduced heat transfer fluid to pass, a curved portion 23 connected to the inlet portion 21*b* and bent toward the chamber entries 11 and 12 of the case 10, and an outlet portion 22*b* that is connected to the curved portion 23 and extends toward the chamber entries 11 and 12 along the direction that the chambers 13 and 14 extend. Due to the above-described configuration, the inlet portion 21*b* and the outlet portion 22*b* are disposed in a direction that the chamber 13 extends inside the case 10 and are disposed parallel to each other within the chamber 13.

The inlet portion 21*b* of the heat exchange tube 21 has an entrance 21*a* opening at an end thereof for introducing the heat transfer fluid therein, and the outlet portion 22*b* has an exit 22*a* opening at an end thereof for discharging the heat transfer fluid therefrom.

Each of the entrance 21*a* and the exit 22*a* of the heat exchange tube 21 fits into their corresponding insertion holes 48 and 49, respectively, so that the heat exchange tube 21 is connected to the inlet space 43 and the outlet space 44, respectively, formed by the cover 41 and the support plate 42.

An upper support panel 29*a* and a lower support panel 29*b* are disposed above and below the heat exchange tube 21, respectively. The upper support panel 29*a* and the lower support panel 29*b* are coupled to each other by a support post 28 so as to surround the heat exchange tubes 21. A vertical panel 27 is also disposed between the upper and lower support panels 29*a* and 29*b* so that the exchange tubes 21 pass therethrough. The vertical panel 27 supports the heat exchange tube 21.

A heat transfer fluid (refrigerant; not shown) introduced through the entrance 41*a* of the cover 41 flows through the inlet space 43 to the entrance 21*a* of the heat exchange tube 21. The heat transfer fluid that has passed through the heat exchange tube 21 is drained from the exit 22*a* of the heat exchange tube 21 and flows through the outlet space 44 to the exit 42*a* of the cover 41.

Figure 5:
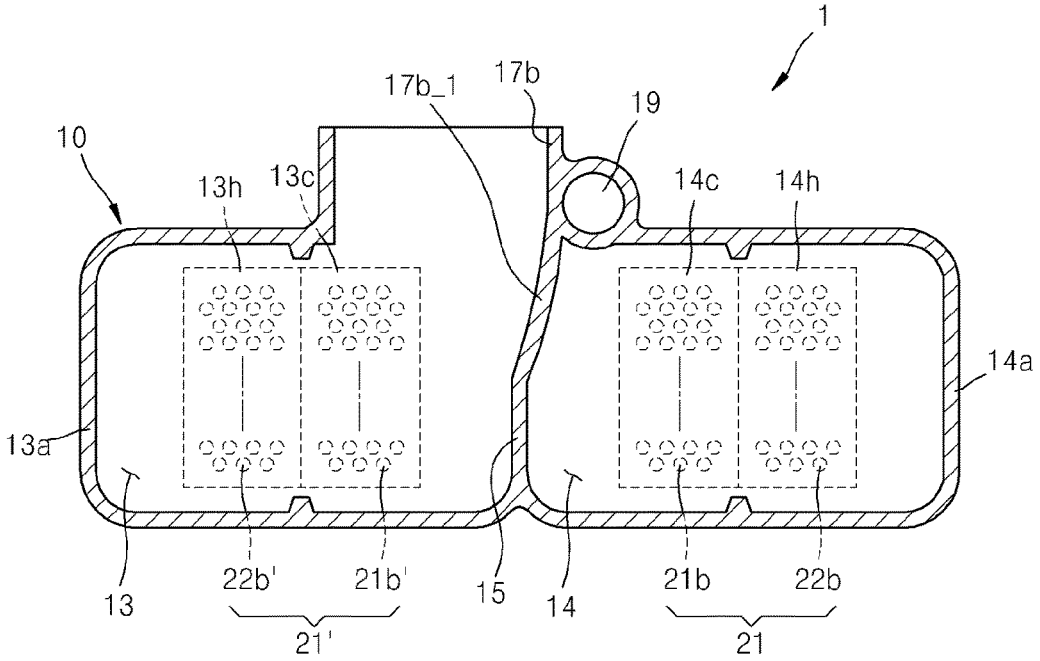
FIG. 5 is a cross-sectional view taken along line V-V of the heat exchanger of FIG. 1 according to an exemplary embodiment.

FIG. 5 is a cross-sectional view taken along line V-V of the heat exchanger 1 of FIG. 1 according to an exemplary embodiment. Referring to FIG. 5, the adjacent chambers 13 and 14 share a common wall 15 therebetween. Although the chamber 13 has a left wall 13*a* on the left side thereof, and the chamber 14 has a right wall 14*a* on the right side thereof, only the common wall 15 is disposed between the chambers 13 and 14.

As described above, the chambers 13 and 14 are formed in the case 10 to have the common wall 15 therebetween. This configuration allows heat exchange between the adjacent chambers 13 and 14 and reduces the overall size of the case 10.

Referring to FIG. 5, heat exchange tubes 21 and 21' are disposed in the adjacent chambers 13 and 14, respectively. The heat exchange tubes 21 and 21' are arranged in consideration of thermal characteristics due to heat exchange in the heat exchange tubes 21 and 21'. In other words, since a direction that an inlet portion 21*b* and an outlet portion 22*b* of the heat exchange tube 21 arranged in the first chamber 13 and an inlet portion 21*b'* and an outlet portion 22*b'* of the heat exchange tube 21' arranged in the second chamber 14 is arranged in a mirror image with respect to the common wall 15, the inlet portions 21*b* and 21*b'* in the heat exchange tubes 21 and 21' face each other in the adjacent chambers 13 and 14 as shown in FIG. 5. That is, the orientation of the inlet portion 21*b* and the outlet portion 22*b* of the heat exchange tube 21 in the first chamber 13 are changed alternately with respect to the inlet portion 21*b'* and the outlet portion 22*b'* of the heat exchange tube 21'.

More specifically, in the heat exchange tube 21 disposed in the chamber 14, an externally introduced heat transfer fluid passes through the inlet portion 21*b* disposed in a left space 14*c* of the chamber 14 so as to transfer heat and is then discharged through the outlet portion 22*b* in a right space 14*h* thereof.

Since heat exchange starts at the left space 14*c* within the chamber 14 as the heat transfer fluid passes therethrough, the left space 14*c* forms a low temperature region compared to the right space 14*h* when the heat transfer fluid is a low temperature refrigerant. On the other hand, since the heat transfer fluid passes through the right space 14*h* in the chamber 14 after heat exchange occurs to some extent, the right space 14*h* forms a high temperature region.

Meanwhile, in the heat exchange tube 21' disposed in the chamber 13, an externally introduced heat transfer fluid passes through an inlet portion 21*b'* disposed in a right space 13*c* of the chamber 13 so as to transfer heat and is then discharged through an outlet portion 22*b'* in a left space 13*h* thereof.

Since heat exchange starts at the right space 13*c* within the chamber 13 as the heat transfer fluid passes therethrough, the right space 13*c* forms a low temperature region compared to the left space 13*h* when the heat transfer fluid is a low temperature refrigerant. On the other hand, since the heat transfer fluid passes through the left space 13*h* in the chamber 13 after heat exchange occurs to some extent, the left space 13*h* forms a high temperature region.

According to the above arrangement of the chambers 13 and 14 and the heat exchange tubes 21 and 21', the right space 13*c* that is a low temperature region of the chamber 13 and the left space 14*c* that is a low temperature region of the chamber 14 are provided adjacent to each other having the common wall 15 in between. That is, moving from a left wall 13*a* of the first chamber 13 to a right wall 14*a* of the second chamber 14, the case 10 has a first high temperature region, a first low temperature region, a second low temperature region and a second high temperature region.

Due to this structure, the chambers 13 and 14 in the case 10 of the heat exchanger 1 is configured so that the first and second low temperature regions (corresponding to the right space 13*c* and the left space 14*c*) are located densely in the central portion of the overall structure of the chamber 13 and 14. The first and second low temperature regions of the chambers 13 and 14 are arranged to be placed adjacent to each other having the common wall 15 in between, thereby enhancing heat exchange characteristics of the heat exchanger.

While the heat exchange tubes 21 and 21' are arranged in the chambers 13 and 14 so that the inlet portions 21*b* and 21*b'* arranged in mirror images with each other with respect to the common wall 15 and disposed closer to the common wall 15 than the outlet portions 22*b* and 22*b'*, the exemplary embodiment is not limited thereto. That is, the outlet portions 22*b* and 22*b'* may be arranged in a mirror image with each other and provided closer to the common wall 15 than the inlet portions 21*b* and 21*b'* so that the high temperature regions (corresponding to the right space 14*h* and the left space 13*h*) face each other.

Referring to FIGS. 1 and 5, the fluid exit 17*b* of the first chamber 13 may extend toward the second chamber 14 adjacent thereto while the fluid entrance 18*a* of the second chamber 14 may extend toward the first chamber 13. As shown in FIG. 5, the fluid exit 17*b* includes an extended portion 17*b*_1 as part of the common wall 15 where the extended portion 17*b*_1 curved toward the other chamber 14. Due to the configuration of the fluid exit 17*b*, it is possible to supply a sufficient flow rate of heat transfer fluid without increasing the overall size of the case 10. Similarly, the fluid entrance 18*a* of the second chamber 14 may extend toward the first chamber 13. Due to the configuration of the fluid exit 18*a*, it is also possible to supply a sufficient flow rate of heat transfer fluid without increasing the overall size of the case 10.

Referring to FIGS. 1 and 5, the case 10 further includes an oil passageway 19 disposed at a portion where the inlet portions 21*b* and 21*b'* face each other, i.e., where the low temperature regions are located.

The oil passageway 19 extends along a direction in which the chambers 13 and 14 extend, and includes an oil entrance 19*a* for introducing oil, an oil exit 19*c* for discharging oil, and a path 19*b* for connecting the oil entrance 19*a* and the oil exit 19*c*.

Referring to FIG. 1, the oil passageway 19 extends slightly obliquely along the low temperature regions between the chambers 13 and 14 according to an exemplary embodiment. However, the exemplary embodiment is not limited thereto, and the oil passageway 19 may be disposed parallel to the extending direction of the chambers 13 and 14.

Due to the above arrangement of the oil passageway 19, oil flows through between the low temperature regions of the case 10 as it passes through the oil passageway 19 of the case 10, thereby maximizing the effect of cooling the oil.

For example, the oil passageway 19, the chambers 13 and 14, the fluid entrances 17*a* and 18*a*, and the fluid exits 17*b* and 18*b* in the case 10 may be manufactured in a single casting process. In this case, it is not necessary to manufacture the oil passageway 19 separately from the case 10 and attach the oil passageway 19 thereto. Furthermore, the effect of cooling oil using the case 10 may be achieved.

Figure 6:
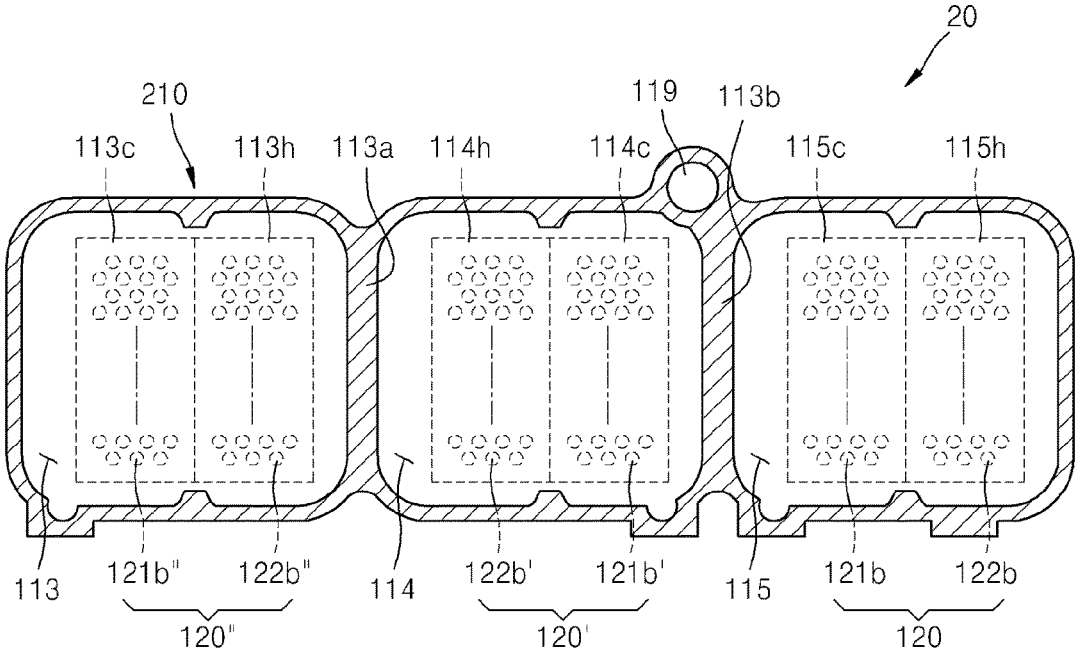
FIG. 6 is a cross-sectional view of a heat exchanger according to another exemplary embodiment.

FIG. 6 is a cross-sectional view of a heat exchanger 20 according to another exemplary embodiment.

Referring to FIG. 6, in the heat exchanger 20 according to the present exemplary embodiment, a case 210 includes three (3) chambers 113, 114,115. The first chamber 113 shares a single wall 113*a* with the second chamber 114, and the second chamber 114 shares a single wall 113*b* with the third chamber 115. Thus, the overall size of the case 210 may be minimized.

Heat exchange tubes 120", 120', and 120 are disposed in the three (3) chambers 113, 114, and 115, respectively. The heat exchange tubes 120" and 120' are arranged so that outlet portions 122*b"* and 122*b'* face each other while the heat exchange tubes 120' and 120 are arranged so that inlet portions 121*b'* and 121*b* face each other. To form such a structure, a direction in which the heat exchange tubes 120", 120', and 120 are arranged in the three (3) chambers 113 and 114, and 115 is changed alternately.

When a heat transfer fluid is a low temperature refrigerant, a region on the left side of the first chamber 113 having an inlet portion 121*b"* therein is a low temperature region 113*c* while a region on the right side having the outlet portion 122*b"* therein is a high temperature region 113*h*. Similarly, in the second chamber 114, a region on the right side having the inlet portion 121*b'* therein is a low temperature region 114*c*, and a region on the left side having an outlet portion 122*b'* is a high temperature region 114*h*. In addition, in the third chamber 115, a region on the left side having the inlet portion 121*b* therein is a low temperature region 115*c*, and a region on the right side having an outlet portion 122*b* therein is a high temperature region 115*h*.

Due to the above arrangement of the heat exchange tubes 120", 120', and 120, the high temperature regions 113*h* and 114*h* are oriented toward each other between the first and second adjacent chambers 113 and 114. The low temperature regions 114*c* and 115*c* are oriented toward each other between the second and third adjacent chambers 114 and 115. Thus, the overall heat exchange performance of the heat exchanger 20 may be significantly increased.

The case 210 further includes an oil passageway 119 through which oil passes. Since the oil passageway 119 extends along the low temperature regions 114*c* and 115*c*, oil cooling effect may be achieved.

Figure 7:
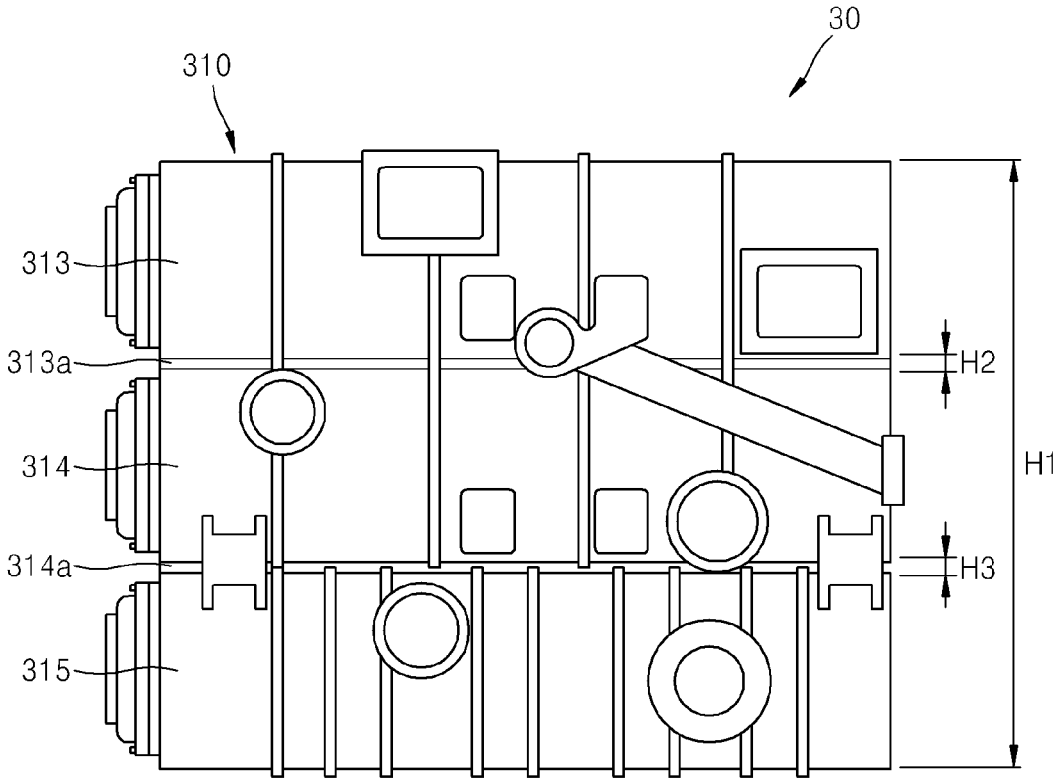
FIG. 7 is a plan view of a heat exchanger according to another exemplary embodiment.

FIG. 7 is a plan view of a heat exchanger 30 according to another exemplary embodiment.

Referring to FIG. 7, in the heat exchanger 30 according to the present exemplary embodiment, a case 310 includes first through third chambers 313 through 315. The first chamber 313 shares a single wall 313*a* having a thickness of H2 with the second chamber 314. The second chamber 314 also shares a single wall 314*a* having a thickness of H3 with the third chamber 315.

Due to the structure in which the three (3) adjacent chambers 313, 314, 315 share the walls 313*a* and 314*a* with each other, the overall size H1 of the case 310 may be minimized. Furthermore, the structure may achieve an effect of heat transfer between the three (3) adjacent chambers 313, 314, 315 through the walls 313*a* and 314*a* therebetween, thereby enhancing the overall heat exchange performance of the heat exchanger 30.

Figure 8:
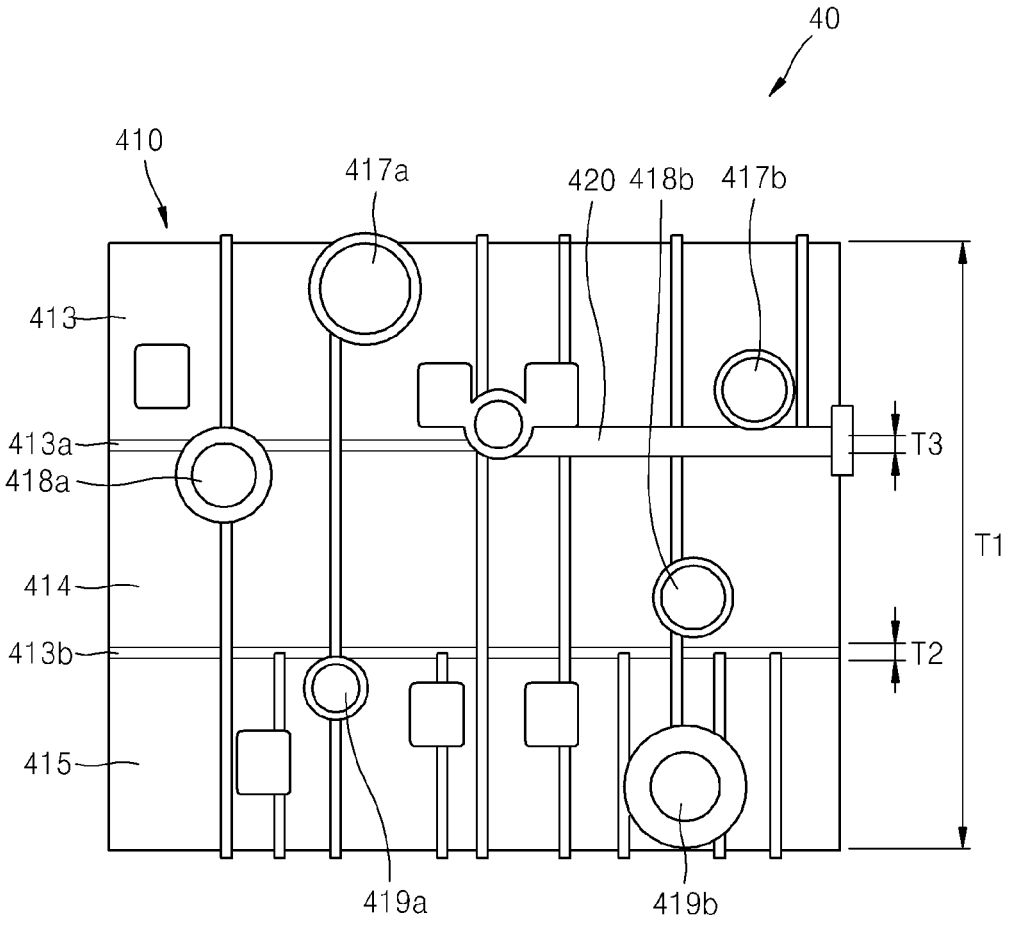
FIG. 8 is a plan view of a heat exchanger according to another exemplary embodiment.

FIG. 8 is a plan view of a heat exchanger 40 according to another exemplary embodiment.

Referring to FIG. 8, in the heat exchanger 40 according to the present exemplary embodiment, a case 410 includes three (3) chambers 413, 414, 415. The first chamber 413 shares a single wall 413*a* having a thickness of T3 with the second chamber 414. The second chamber 414 also shares a single wall 414*a* having a thickness of T2 with the third chamber 415.

The three (3) chambers 413, 414, 415 include fluid entrances 417*a*, 418*a*, and 419*a* for supplying a heat exchange fluid thereto, respectively. The three (3) chambers 413, 414, 415 also include fluid exits 417*b*, 418*b*, and 419*b* for discharging the heat exchange fluid to the outside, respectively. An oil passageway 420 is disposed along a low temperature region between the first and second adjacent chambers 413 and 414 in such a way as to extend parallel to a direction that the first and second chambers 413 and 414 extend.

The fluid entrance 417*a* and the fluid exit 419*b* are disposed and penetrate within the first chamber 413 and the third chamber 415, respectively. Thus, the fluid entrance 417*a* and the fluid exit 419*b* may supply a sufficient flow rate of heat exchange fluid without protruding out from the case 410.

Due to the above-described structure, an overall length T1 of the case 410 may be minimized, thereby achieving compact designs for the case 410 and the heat exchanger 40.

Figure 9:
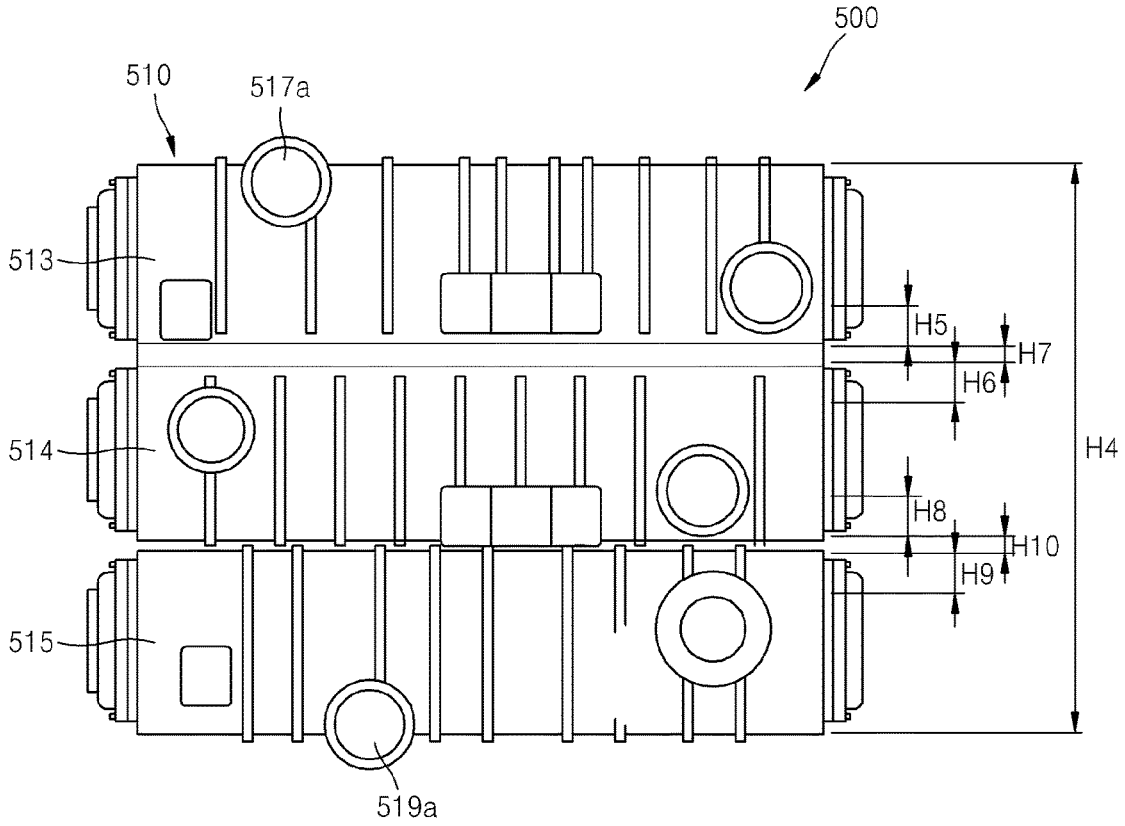
FIG. 9 is a plan view of a heat exchanger according to an example of the related art.
Figure 10:
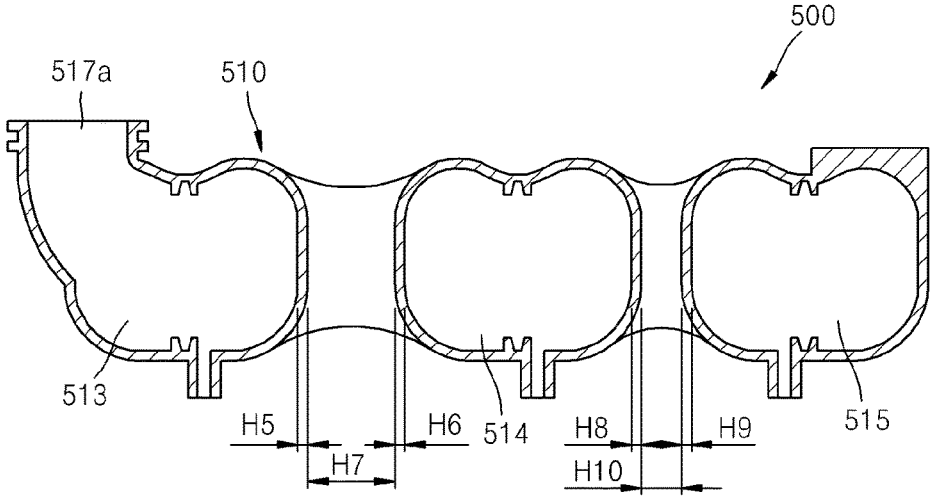
FIG. 10 is a cross-sectional view of the heat exchanger of FIG. 9 according to the related art.

FIG. 9 is a plan view of a heat exchanger according to an example of the related art and FIG. 10 is a cross-sectional view of the heat exchanger of FIG. 9 according to the related art.

FIGS. 9 and 10 illustrate the heat exchanger 500 manufactured for comparison with the heat exchangers according to the exemplary embodiments. Referring to FIGS. 9 and 10, in a case 510 of the heat exchanger 500, a first chamber 513 has a wall with a thickness of H5, and a second chamber 514 has a wall with a thickness of H6. The first and second chambers 513 and 514 are separated from each other by a distance of H7.

The second chamber 514 also has a wall with a thickness of H8, and a third chamber 515 has a wall with a thickness of H9. The second and third chambers 514 and 515 are separated from each other by a distance of H10.

Furthermore, since portions of the fluid entrance 517*a* of the first chamber 513 and the fluid entrance 519*a* of the third chamber 515 protrude outward from the case 510, an overall size H4 of the case 510 may be increased.

Figure 11:
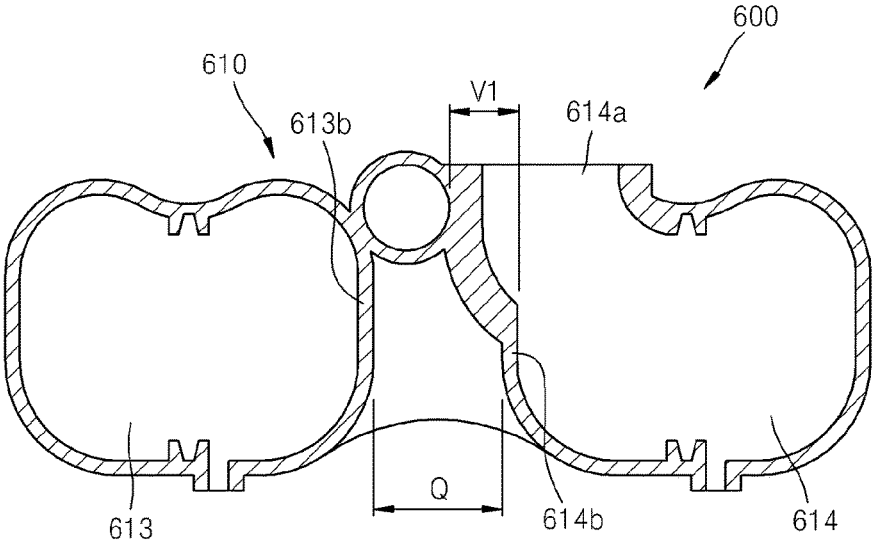
FIG. 11 is a cross-sectional view of a heat exchanger according to another example of the related art.

FIG. 11 is a cross-sectional view of a heat exchanger according to another example of the related art.

Referring to FIG. 11, a case 610 of the heat exchanger 600 includes two chambers 613 and 614 adjacent to each other. To increase the size of a fluid entrance 614*a* of the chamber 614 on the right side by V1, a wall 613*b* of the chamber 613 on the left side has to be separated from a wall 614*b* of the chamber 614 by a large distance Q. This structure may hinder heat exchange between the chambers 613 and 614.

Figure 12:
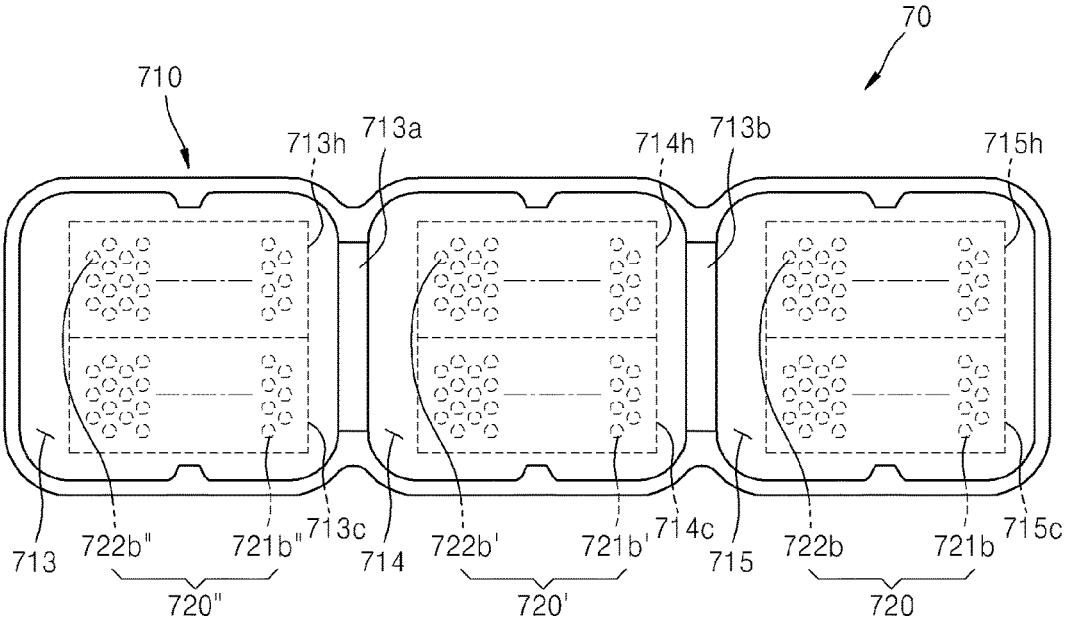
FIG. 12 is a cross-sectional view of a heat exchanger according to another exemplary embodiment.

FIG. 12 is a cross-sectional view of a heat exchanger 70 according to another exemplary embodiment.

Referring to FIG. 12, in the heat exchanger 70 according to the present exemplary embodiment, a case 710 includes three (3) chambers 713, 714, 715. The first chamber 713 shares a single wall 713*a* with the second chamber 714, and the second chamber 714 shares a single wall 714*b* with the third chamber 715. Thus, the overall size of the case 710 may be minimized.

Heat exchange tubes 720", 720', and 720 are disposed in the three (3) chambers 713, 714, and 715, respectively. The heat exchange tubes 720", 720', and 720 are arranged so that outlet portions 722*b*" and 722*b*' face each other between the first and second chambers 713 and 714 and outlet portions 722*b*' and 722*b* face each other between the second and third chambers 714 and 715. The heat exchange tubes 720", 720', and 720 are also arranged so that inlet portions 721*b*" and 721*b*' face each other between the first and second chambers 713 and 714 and inlet portions 721*b*' and 721*b* face each another between the second and third chambers 714 and 715.

To form the above-described structure, the outlet portions 722*b*", 722*b*', and 722*b* are separated from the inlet portions 721*b*", 721*b*', and 721*b*, respectively, in a vertical direction intersecting a horizontal direction in which the first through third chambers 713, 714, and 715 are arranged. A direction in which the heat exchange tubes 720", 720', and 720 are arranged in the adjacent chambers 713 through 715 remains the same.

When a heat transfer fluid is a low temperature refrigerant, lower regions in the first through chambers 713 through 715 where the inlet portions 721*b*", 721*b*', and 721*b* face one another are low temperature regions 713*c*, 714*c*, and 715*c*. Upper regions where the outlet portions 722*b*", 722*b*', and 722*b* face one another are high temperature regions 713*h*, 714*h*, and 715*h*.

Due to the above arrangement of the heat exchange tubes 720", 720', and 720, the low temperature regions 713*c*, 714*c*, and 715*c* are directed toward one another, and the high temperature regions 713*h*, 714*h*, and 715*h* are directed toward one another, among the first through third chambers 713, 714, and 715, thereby significantly improving overall heat exchange performance of the heat exchanger.

It should be understood that the exemplary embodiments described therein should be considered in a descriptive sense only and not for purposes of limitation. While one or more embodiments of the present invention have been described with reference to the figures, it will be understood by those of ordinary skill in the art that various changes in form and details may be made therein without departing from the spirit and scope of the present invention as defined by the following claims.

What is claimed is:

1. A heat exchanger comprising:

a case comprising a plurality of chambers including a first chamber and a second chamber, the first and second chambers being disposed parallel to each other and the first chamber having a first chamber entry opening to the outside and the second chamber having a second chamber entry opening to the outside;

a plurality of heat exchange tubes accommodated in each of the first and second chambers, each heat exchange tube comprising:

an inlet portion that extends along an axial direction of the first and second chambers and allows an externally introduced heat transfer fluid to pass;

an intermediate portion connected to the inlet portion and curved from the inlet portion; and an outlet portion that is extending from the intermediate portion, extends toward the chamber entries along the axial direction, and discharges the heat transfer fluid received from the inlet portion and the intermediate portion to the outside; and an oil passageway extending along the axial direction and provided between the inlet portions of the first chamber and the inlet portions of the second chamber, the oil passageway provided at an exterior of the case, wherein the first and second chambers share a single wall provided between the first and second chambers, the single wall extending along the axial direction of the first and second chambers, and wherein the heat exchange tubes of the plurality of chambers are arranged so that the inlet portions in the first chamber face the inlet portions of the second chamber or the outlet portions of the first chamber face the outlet portions of the second chamber.

2. The heat exchanger of claim 1, wherein the inlet portion of each heat exchange tube of the one of the first and second chambers is arranged as a mirror image from the inlet portion of the each heat exchange tube of the adjacent chamber of the one of the first and second chambers with respect to the wall disposed between the one and the adjacent chambers, and wherein the outlet portion of the each heat exchange tube of the one of the first and second chambers is arranged as a mirror image from the outlet portion of the each heat exchange tube of the adjacent chamber of the one of the first and second chambers with respect to the wall disposed between the one and the adjacent chambers.

3. The heat exchanger of claim 1, wherein the case further comprises:

fluid entry passages, each of the fluid entry passages extending through at least one portion of each of the first and second chambers and supply a heat exchange fluid to respective one of the first and second chambers; and fluid exit passages, each of the fluid exit passages extending through at least another portion of each of the chambers and discharge the heat exchange fluid to the outside from the respective one of the first and second chambers.

4. The heat exchanger of claim 3, wherein at least one of the fluid entrance and the fluid exit of the respective one of the plurality of chambers comprises a quadrangular cross-section.

5. The heat exchanger of claim 3, wherein at least one of the fluid entrance and the fluid exit of the respective one of the plurality of chambers comprises an extended portion extending to the adjacent chamber of one of the plurality of chambers.

6. The heat exchanger of claim 1, wherein the oil passageway extends in an extending direction of the each of the plurality of chambers, and comprises:

an oil entrance for introducing oil, and an oil exit for discharging oil.

7. The heat exchanger of claim 1, wherein the inlet portion and the outlet portion of the each of the heat exchange tubes are disposed from each other in a direction corresponding to an arranging direction of the plurality of chambers, and a direction in which the inlet and outlet portions of the each of the heat exchange tubes are arranged in adjacent ones of the chambers is changed alternately.

8. The heat exchanger of claim 1, wherein the inlet portion and the outlet portion of the each of the heat exchange tubes are disposed from each other corresponding to a direction perpendicular to an arranging direction of the plurality of chambers.

9. A case for a heat exchanger, the case comprising:

a first chamber having a first chamber entry opening;

a second chamber having a second chamber entry opening, each of the first and second chambers having a first region and a second region along a widthwise direction of die case; and an oil passageway provided between the first chamber and the second chamber and extending along an axial direction of the first and second chambers and provided between the inlet portions of the first chamber and the inlet portions of the second chamber, the oil passageway provided at an exterior of the case, wherein the first and second chambers share a single wall with an adjacent chamber of the each chamber, wherein the first and second chambers extend in a parallel direction from each other along the axial direction, the widthwise direction being perpendicular to the axial direction, wherein the first regions of each of the first and second chambers have a higher temperature than the second regions of each of the first and second chambers, wherein the first regions of each of the first and second chambers are provided away from the single wall farther than the second regions of the first and second chambers, and wherein the oil passageway is provided between the second region of the first chamber and the second region of the second chamber.

10. The case of claim 9, further comprising:

fluid entry passages, each of the fluid entry passages extending through at least one portion of each of the first and second chambers and supply a heat exchange fluid to respective one of the first and second chambers; and fluid exit passages, each of the fluid exit passages extending through at least another portion of each of the chambers and discharge the heat exchange fluid to the outside from the respective one of the first and second chambers.

11. The case of claim 10, wherein at least one of the fluid entrance and the fluid exit of the respective one of the first and second chambers comprises a quadrangular cross-section.

12. The case of claim 10, wherein at least one of the fluid entrance and the fluid exit of the respective one of the first and second chambers comprises an extended portion extending to the adjacent chamber of the respective one of the plurality of chambers.

13. The case of claim 9, wherein the oil passageway extends in an extending direction of the each of the plurality of chambers, and comprises:

an oil entrance for introducing oil; and an oil exit for discharging oil.

* * * * *